US005867013A

United States Patent [19]

Yu

[11] Patent Number: 5,867,013

[45] Date of Patent: Feb. 2, 1999

[54] STARTUP CIRCUIT FOR BAND-GAP REFERENCE CIRCUIT

[75] Inventor: Donald Y. Yu, Fremont, Calif.

[73] Assignee: Cypress Semiconductor Corporation, San Jose, Calif.

[21] Appl. No.: 974,436

[22] Filed: Nov. 20, 1997

[51] Int. Cl.[6] ..... G05F 3/16

[52] U.S. Cl. ..... 323/314; 323/901; 327/539

[58] Field of Search ..... 323/313, 314, 323/315, 316, 901; 327/539

[56] References Cited

U.S. PATENT DOCUMENTS 5,061,862 10/1991 Tamagawa ..... 323/312

5,629,611 5/1997 McIntyre ..... 323/313

*Primary Examiner*—Shawn Riley

*Attorney, Agent, or Firm*—Blakely Sokoloff Taylor & Zafman, LLP

[57] ABSTRACT

A circuit includes a band-gap reference circuit and a start-up circuit coupled between an output and an input of the band-gap reference circuit. When the output of the band-gap reference circuit is below a start-up voltage threshold, the start-up circuit provides a first voltage at the input of the band-gap reference circuit which, in turn, causes the band-gap reference circuit to produce a desired voltage at the output. When the desired voltage has been reached, i.e., a voltage corresponding to the start-up voltage threshold, the start-up circuit turns off and does not interfere with the normal operation of the band-gap reference circuit. The start-up circuit may include first circuitry configured to produce a first voltage if a voltage signal at the output of the band-gap reference circuit is below the start-up voltage threshold. The start-up circuit may further include second circuitry coupled to the first circuitry and configured to produce a second voltage at the input of the band-gap reference circuit in response to the first voltage. The start-up voltage threshold may be a desirable output voltage, for example approximately 1.25 volts.

15 Claims, 4 Drawing Sheets

STARTUP CIRCUIT FOR BAND-GAP REFERENCE CIRCUIT

FIELD OF THE INVENTION

The present invention relates to band-gap reference circuits and, more particularly, to an improved start-up circuit therefor.

BACKGROUND

Band-gap reference bias circuits have long been used to produce reference voltages. Practical implementations of band-gap reference circuits take many forms and some embodiments thereof are described in detail in Paul R. Gray and Robert G. Meyer, Analysis and Design of Analog Integrated Circuits, ch. 4, pp. 289–300 (2 ed., 1984). One such band-gap reference circuit 10 is illustrated in FIG. 1. Band-gap reference circuit 10 uses a feedback loop 12 to establish an operating point for the circuit such that the output voltage V out is equal to a base-emitter voltage plus a voltage proportional to the difference between two base-emitter voltages for transistors Q1 and Q2. Band-gap reference circuit 10 is bi-stable as a result of the positive feedback path from the output of operational amplifier A through resistor R1, to the positive input of op-amp A. One stable state is the desired one, with an output V out approximately equal to 1.25 V. In this state, the feedback signal to the negative input of op-amp A dominates. The positive feedback in this state is minimal because of the low impedance of Q1. With zero output voltage (the other stable state), however, Q1 is now in a high impedance state and the positive feedback path will keep V out at 0 V. Accordingly, appropriate start-up circuitry must be included with the band-gap reference circuit 10 to ensure operation in the desired state.

Such a start-up circuit 20 is illustrated in FIG. 2. Start-up circuit 20 is coupled to an input of band-gap reference circuit 10 at node 22. It will be appreciated that if the output voltage V out is zero volts, as may occur at start-up, start-up circuit 20, and in particular, transistor T1, will pull-up the voltage at node 22, causing the output voltage to rise to a desired V out. Feedback loop 12 will then operate to hold the voltage at this desired level.

Unfortunately, start-up circuit 20 is sensitive to process, temperature and power supply variations. If not carefully designed, transistor T1 may still conduct after start-up, i.e., after a desired output voltage V out has been reached. This may interfere with the normal operation of band-gap reference circuit 10, and, as a result, the output voltage V out may fluctuate.

SUMMARY OF THE INVENTION

The present invention provides a reliable start-up circuit for a band-gap reference circuit. In one embodiment, a circuit including a band-gap reference circuit and a start-up circuit coupled between an output and an input of the band-gap reference circuit is provided. In other words, the start-up circuit is placed in a feedback path between an output and an input of the band-gap reference circuit. When the output of the band-gap reference circuit is below a start-up voltage threshold, the start-up circuit provides a first voltage at the input of the band-gap reference circuit which, in turn, causes the band-gap reference circuit to produce a desired voltage at the output. When the desired voltage has been reached, i.e., a voltage corresponding to the start-up voltage threshold, the start-up circuit turns off and does not interfere with the normal operation of the band-gap reference circuit.

For one embodiment, the start-up circuit may include first circuitry configured to produce a first voltage if a voltage signal at the output of the band-gap reference circuit is below the start-up voltage threshold. The start-up circuit may further include second circuitry coupled to the first circuitry and configured to produce a second voltage at the input of the band-gap reference circuit in response to the first voltage. The start-up voltage threshold may be a desirable output voltage, for example approximately 1.25 volts.

In a further embodiment, the start-up circuit may include a first transistor coupled to the output of the band-gap reference circuit, a second transistor coupled between the first transistor and a voltage source (e.g., Vcc), an inverter coupled to a common point of interconnection between the first and second transistors, and a third transistor coupled to the inverter and between the voltage source (e.g., Vcc) and the input of the band-gap reference circuit. The second and third transistors may be p-channel transistors while the first transistor may be an n-channel transistor. The start-up circuit and band-gap reference circuit may be included within a programmable logic device, for example, where the band-gap reference circuit is used to provide a regulated voltage for a programming voltage generator within the programmable logic device.

In a further embodiment, a non-volatile memory cell may be programmed by applying a programming voltage to the cell for a period of time sufficient to store a logic state in the cell. The programming voltage may be regulated by a band-gap reference voltage produced with a band-gap reference circuit having a start-up circuit coupled between an output and an input of the band-gap reference circuit. Upon power-up of the band-gap reference circuit, the start-up circuit may produce a first voltage at the input of the band-gap reference so long as the band-gap reference voltage is below a start-up voltage threshold, for example, 1.25 volts.

BRIEF DESCRIPTION OF THE DRAWINGS

The present invention is illustrated by way of example, and not limitation, in the figures of the accompanying drawings in which.

DETAILED DESCRIPTION

Figure 1:
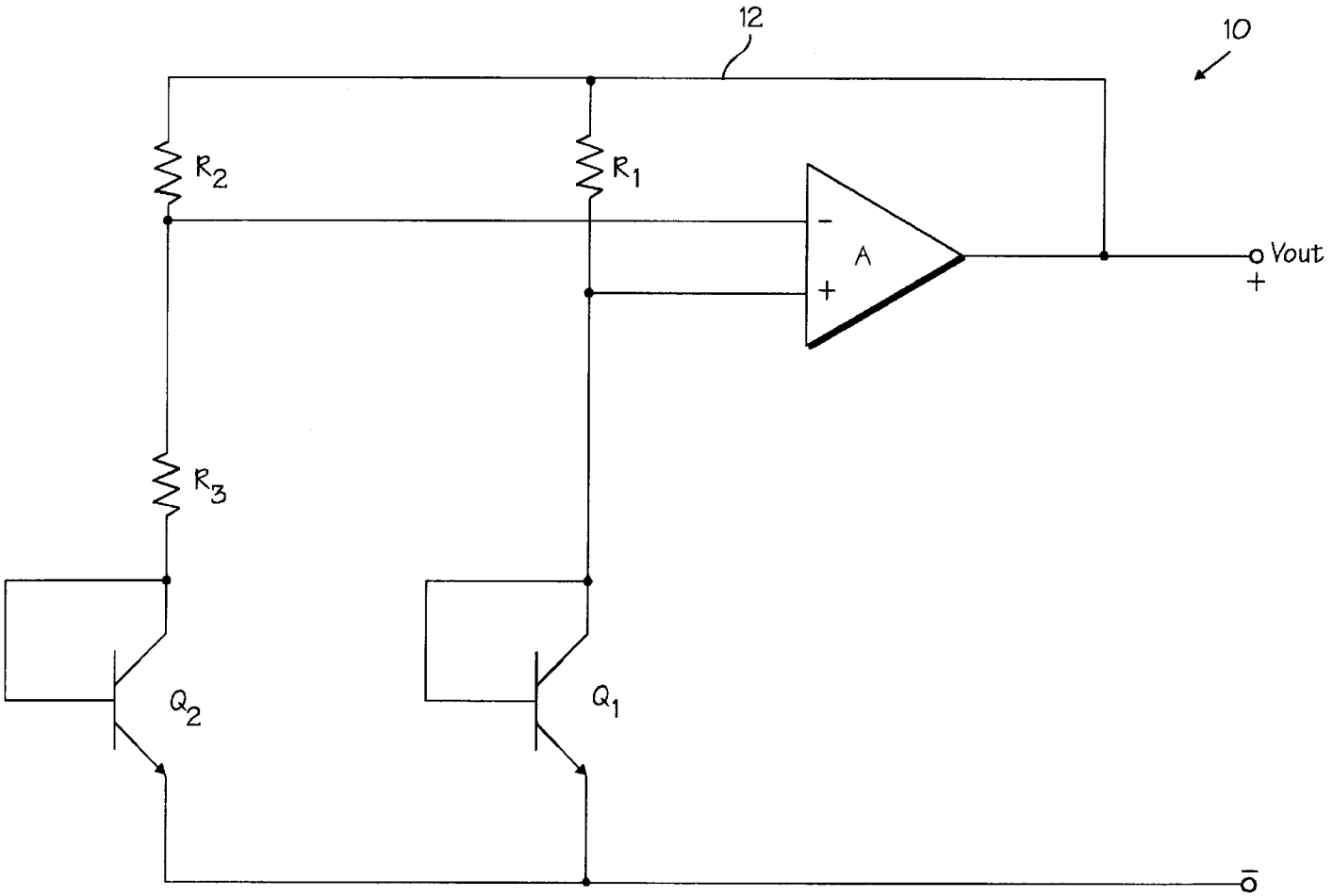
Fig. 1 (PRIOR ART)
FIG. 1 illustrates a conventional band-gap reference circuit.
Figure 2:
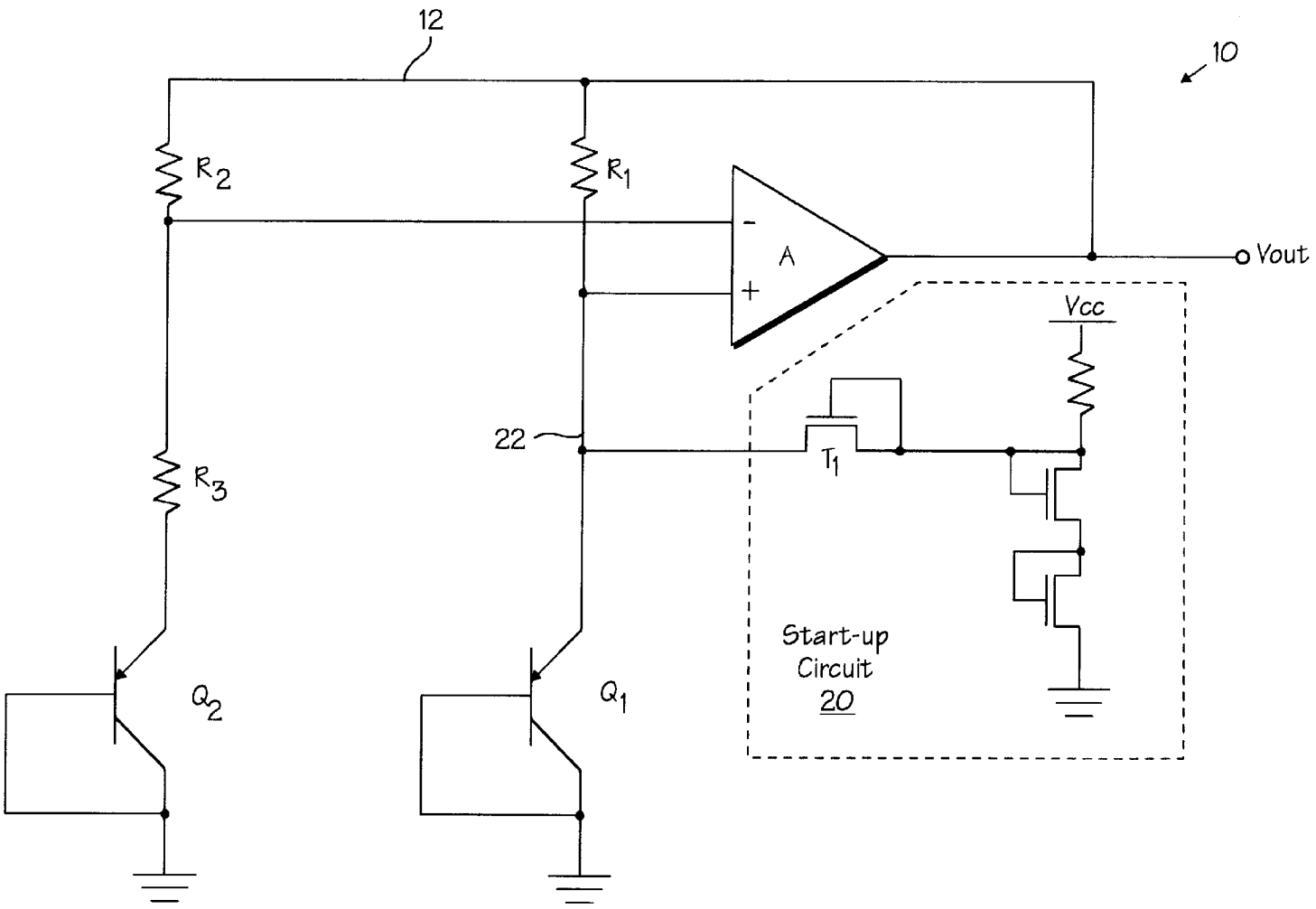
Fig. 2 (PRIOR ART)
FIG. 2 illustrates a conventional start-up circuit for use with a conventional band-gap reference circuit.

Described herein is an improved start-up circuit for a band-gap reference circuit. The present invention provides a reliable start-up circuit for a band-gap reference circuit. In one embodiment, a circuit including a band-gap reference circuit and a start-up circuit coupled between an output and an input of the band-gap reference circuit is provided. In other words, the start-up circuit is placed in a feedback path between an output and an input of the band-gap reference circuit. When the output of the band-gap reference circuit is below a start-up voltage threshold, the start-up circuit provides a first voltage at the input of the band-gap reference circuit which, in turn, causes the band-gap reference circuit to produce a desired voltage at the output. When the desired voltage has been reached, i.e., a voltage corresponding to the start-up voltage threshold, the start-up circuit turns off and does not interfere with the normal operation of the band-gap reference circuit.

For one embodiment, the start-up circuit may include first circuitry configured to produce a first voltage if a voltage signal at the output of the band-gap reference circuit is below the start-up voltage threshold. The start-up circuit may further include second circuitry coupled to the first circuitry and configured to produce a second voltage at the input of the band-gap reference circuit in response to the first voltage. The start-up voltage threshold may be a desirable output voltage, for example approximately 1.25 volts.

In a further embodiment, the start-up circuit may include a first transistor coupled to the output of the band-gap reference circuit, a second transistor coupled between the first transistor and a voltage source (e.g., Vcc), an inverter coupled to a common point of interconnection between the first and second transistors, and a third transistor coupled to the inverter and between the voltage source (e.g., Vcc) and the input of the band-gap reference circuit. The second and third transistors may be p-channel transistors while the first transistor may be an n-channel transistor. The start-up circuit and band-gap reference circuit may be included within a programmable logic device, for example, where the band-gap reference circuit is used to provide a regulated voltage for a programming voltage generator within the programmable logic device.

In a further embodiment, a non-volatile memory cell may be programmed by the applying a programming voltage to the cell for a period of time sufficient to store a logic state in the cell. The programming voltage may be regulated by a band-gap reference voltage produced with a band-gap reference circuit having a start-up circuit coupled between an output and an input of the band-gap reference circuit. Upon power-up of the band-gap reference circuit, the start-up circuit may produce a first voltage at the input of the band-gap reference so long as the band-gap reference voltage is below a start-up voltage threshold, for example, 1.25 volts.

Figure 3:
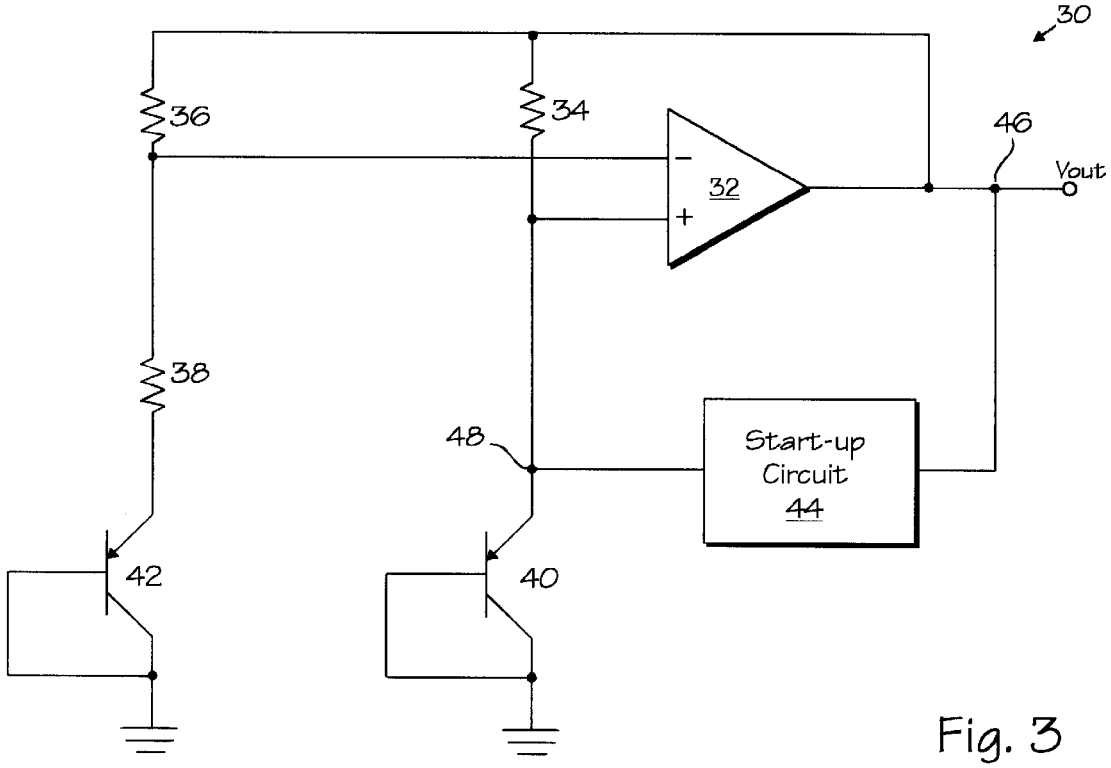
FIG. 3 illustrates a circuit made up of a band-gap reference circuit and start-up circuit configured according to one embodiment of the present invention.

FIG. 3 illustrates a circuit including a band-gap reference circuit 30 and a start-up circuit 44 configured according to one embodiment of the present invention. Band-gap reference circuit 30 includes operational amplifier 32, resistors 34, 36, 38 and transistors 40 and 42, coupled as shown. It should be appreciated that band-gap reference circuit 30 is configured as a conventional band-gap reference circuit, however, start-up circuit 44 which is coupled between an output of the band-gap reference circuit 30 and an input of the band-gap reference circuit 30 (shown as nodes 46 and 48, respectively) differs from start-up circuits of the past. In particular, start-up circuit 44 is included in a separate feedback path between an output of the band-gap reference circuit 30 and an input thereof. In operation, whenever the output voltage of band-gap reference circuit 30, shown as V out in FIG. 3, is below a start-up voltage threshold, start-up circuit 44 will pull the voltage at node 48 high. This will cause operational amplifier 32 to produce an output voltage signal and, when the output voltage V out reaches a desired voltage, e.g., 1.25 volts, start-up circuit 44 produces zero current at node 48 and will not interfere with the normal operation of band-gap reference circuit 30. The output voltage V out of band-gap reference circuit 30 will remain at the desired voltage level in accordance with conventional operations of band-gap reference voltage circuits.

For the illustrated embodiment in FIG. 3, resistors 34 and 36 may be approximately equal in size and each may be approximately 10 times the size of resistor 38. For example, if resistor 38 is approximately 2.3 kΩ, resistors 34 and 36 may each be approximately 23 kΩ. In addition, bi-polar transistors 40 and 42 are shown as PNP type transistors for the embodiment illustrated in FIG. 3. However, it should be appreciated that transistors 40 and 42 may be NPN transistors in other embodiments.

Figure 4:
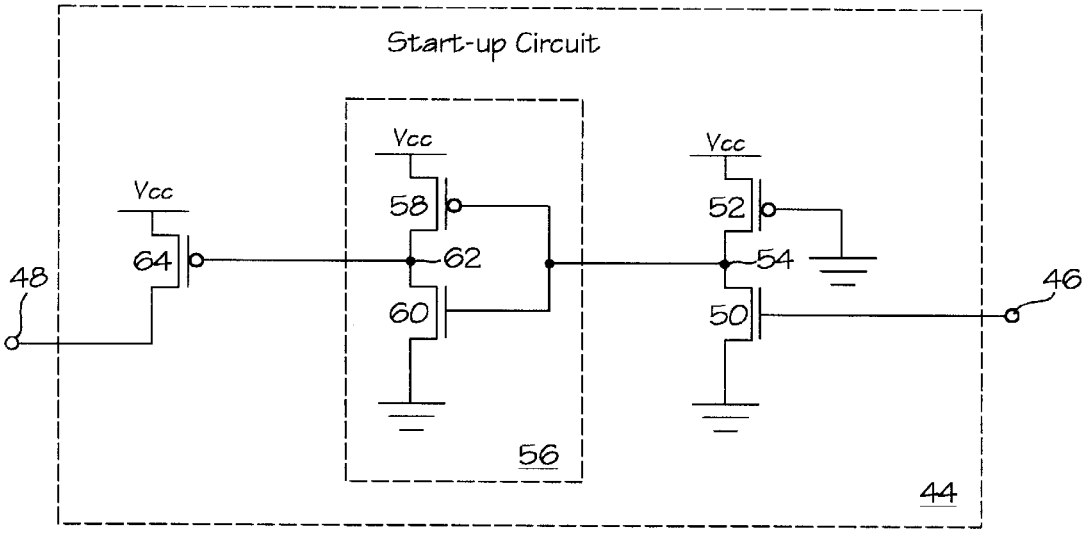
FIG. 4 illustrates one embodiment of a start-up circuit configured according to the present invention.

One embodiment of start-up circuit 44 is illustrated in FIG. 4. For this example, start-up circuit 44 includes transistors 50 and 52 which are configured to produce a logic high voltage at node 54 (their common point of interconnection) whenever the voltage at node 46 is below the threshold voltage of transistor 50. In other words, whenever the voltage at node 46 is below the start-up voltage threshold, transistor 50 will be off and node 54 will be pulled high by the action of transistor 52. Conversely, when the voltage at node 46 reaches the threshold voltage of transistor 50, transistor 50 turns on and pulls down the voltage at node 54. In this embodiment, transistor 52 is a p-channel transistor having its gate coupled to ground, and is therefore always activated. Transistor 50 is shown as an n-channel transistor. It should be appreciated, however, that other transistors may be used so long as the overall operation of this portion of start-up circuit 44 remains substantially the same.

Coupled to node 54 is a conventional CMOS inverter 56 made up of p-channel transistor 58 and n-channel transistor 60. In operation, when the voltage at node 54 is a logic high, inverter 56 operates to pull-down the voltage at node 62. Thus, when the voltage at node 46 is below the start-up voltage threshold, the voltage at node 62 is a logic low. When the voltage at node 46 has reached the start-up voltage threshold, the voltage at node 62 is a logic high.

Start-up circuit 44 also includes p-channel transistor 64 which is coupled to the output of inverter 56 (i.e., node 62) and between a voltage source Vcc and the input to band-gap reference circuit 30, i.e., node 48. When the voltage at node 62 is a logic low, transistor 64 operates to pull the voltage at node 48 high. Thus, when the voltage at node 46 is below the start-up voltage threshold, the voltage at node 48 is a logic high. Conversely, when the voltage at node 46 is at or above the start-up voltage threshold, node 48 is decoupled from the voltage source.

In operation, the circuit including the band-gap reference circuit 30 and start-up circuit 44 shown in FIG. 3 may power-up in one of two states. That is, upon power-up, the voltage V out at the output of the band-gap reference circuit 30 may be zero volts or it may be at the desired output level, for example 1.25 volts. If the circuit powers up such that V out equal approximately 1.25 volts, start-up circuit 44 does not affect the operation of the band-gap reference circuit 30 and this output voltage is maintained using the conventional feedback path of band-gap reference circuit 30.

If, however, the circuit powers up such that V out is initially zero volts, start-up circuit 44 is activated and produces a voltage at node 48 (e.g., a logic high voltage) which causes operational amplifier 32 to produce an output voltage. The output voltage will rise to the point where V out is approximately equal to the start-up voltage threshold, i.e., the threshold voltage of transistor 50, at which time start-up circuit 44 will no longer produce an output voltage at node 48, as described above. From this point on, the desired output voltage V out will be maintained by band-gap reference circuit 30.

Figure 5:
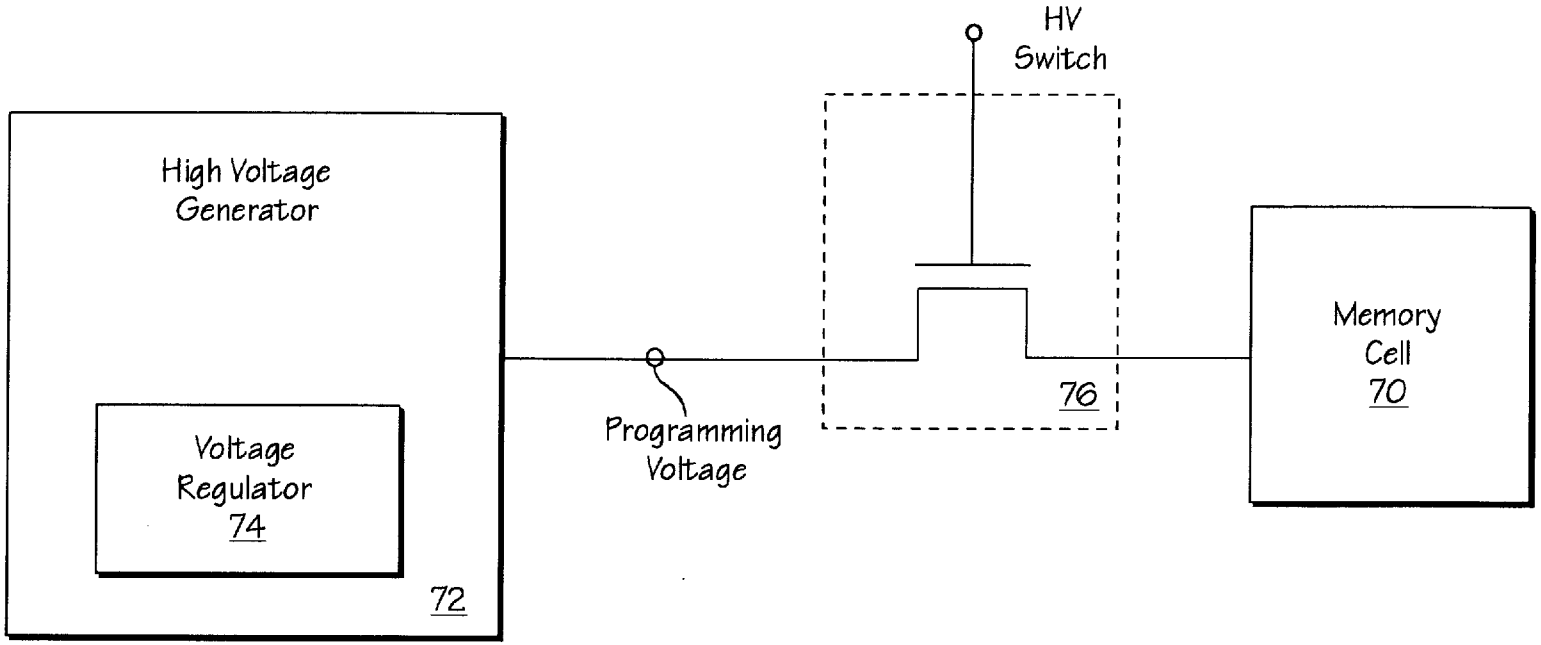
FIG. 5 illustrates a programmable device including a memory cell coupled to a high voltage generator which includes a voltage regulator configured in accordance with one embodiment of the present invention.

The present invention may find application in a number of situations, for example, wherever band-gap reference circuits are used. One such application finds the present invention included within a programmable device (e.g., a memory device or a programmable logic device) configured to be in-system programmable. That is, the programmable device may include internal high voltage programming circuitry for programming non-volatile memory cells (e.g., electrically erasable programmable read-only memory cells). Such in-system programmable devices need not rely on external high voltage sources for programming. As is well known in the art, non-volatile memory cells of such programmable devices are programmed by the application of a high voltage, (e.g., 12 volts) which allows electrons to tunnel on to the floating gate of the non-volatile memory cell. Such a programming scheme is illustrated conceptionally in FIG. 5 where a memory cell 70 has a programming voltage applied by a high voltage generating circuit 72 through a high voltage switch 76. Included within high voltage generator circuit 72 is a voltage regulator 74 which may include a band-gap reference circuit having a start-up circuit configured in accordance with the present invention. With such a system, the non-volatile memory cell 70 may be programmed by applying the programming voltage for a period of time sufficient to store a desired logic state in the cell. The programming voltage is regulated by the band-gap reference voltage produced by the band-gap reference circuit included within the voltage regulator 74. Of course, many other utilizations for the present invention may be possible.

Thus, an improved start-up circuit for band-gap reference circuit has been described. Although discussed with reference to specific illustrated embodiments, the present invention should not be limited to these embodiments. For example, n-channel transistors in the illustrated embodiments may be replaced with p-channel transistors, and vice-versa, and voltage sources altered accordingly so long as the above-described operation is maintained. Thus, the present invention should be measured only in terms of the claims which follow.

What is claimed is:

1. A circuit comprising:

a band-gap reference circuit; and a start-up circuit coupled between an output of said band-gap reference circuit and an input of said band-gap reference circuit, said start-up circuit having:

first circuitry configured to produce a first voltage when a voltage signal at said output of said band-gap reference circuit is below a start-up voltage threshold; and second circuitry coupled to said first circuitry and configured to produce a second voltage at said input of said band-gap reference circuit in response to said first voltage.

2. The circuit of claim 1 wherein said second circuitry comprises an inverter circuit.

3. The circuit of claim 1 wherein said first circuitry is further configured to produce a zero current output when said voltage signal at said output of said band-gap reference signal is above said start-up voltage threshold.

4. A programmable device comprising the circuit of claim 1.

5. The programmable device of claim 4 wherein said programmable device is a programmable logic device.

6. The programmable device of claim 5 comprising a programming voltage generator including said circuit.

7. A circuit comprising:

a band-gap reference circuit; and a start-up circuit coupled between an output of said band-gap reference circuit and an input of said band-gap reference circuit, said start-up circuit having:

a first transistor coupled to said output of said band-gap reference circuit;

a second transistor coupled between said first transistor and a voltage source;

an inverter coupled to a common point of interconnection between said first and second transistors; and a third transistor coupled to said inverter and between said voltage source and said input of said band-gap reference circuit.

8. The circuit of claim 7 wherein said second and third transistors are p-channel transistors and said first transistor is an n-channel transistor.

9. The circuit of claim 7 wherein said first and second transistors are configured to produce a first voltage when a voltage signal at said output of said band-gap reference circuit is below a start-up voltage threshold; and said inverter and said third transistor are configured to produce a second voltage at said input of said band-gap reference circuit in response to said first voltage.

10. The circuit of claim 9 wherein said first and second transistors are further configured to produce a zero current output when said voltage signal at said output of said band-gap reference signal is above said start-up voltage threshold.

11. A programmable device comprising the circuit of claim 5.

12. The programmable device of claim 11 wherein said programmable device is a programmable logic device.

13. The programmable device of claim 12 comprising a programming voltage generator including said circuit.

14. A method, comprising producing a start-up voltage at an output of a band-gap reference circuit using a start-up circuit coupled between said output of said band-gap reference circuit and an input of said band-gap reference circuit, said start-up circuit producing a first voltage when a voltage signal at said output of said band-gap reference circuit is below a start-up voltage threshold and said start-up circuit producing a second voltage at said input of said band-gap reference circuit in response to said first voltage.

15. A method of programming a non-volatile memory cell comprising applying a programming voltage to said memory cell for a period of time sufficient to store a logic state in said memory cell, said programming voltage being regulated by a band-gap reference voltage produced with a band-gap reference circuit having a start-up circuit coupled between an output and an input of said band-gap reference circuit, said start-up circuit producing a first voltage when a voltage signal at said output of said band-gap reference circuit is below a start-up voltage threshold and said start-up circuit producing a second voltage at said input of said band-gap reference circuit in response to said first voltage.

* * * * *